United States Patent [19]

Putsch et al.

[11] Patent Number: 5,014,432

[45] Date of Patent: May 14, 1991

[54] CENTER-CUTTERS

[75] Inventors: Ralf Putsch; Karl Putsch, both of Wuppertall, Fed. Rep. of Germany

[73] Assignee: Knipex-Werk C. Gustav Putsch, Wuppertal, Fed. Rep. of Germany

[21] Appl. No.: 314,475

[22] Filed: Feb. 21, 1989

[30] Foreign Application Priority Data

Mar. 5, 1988 [DE] Fed. Rep. of Germany ... 8803016[U]

[51] Int. Cl.[5] ..... B26B 12/00

[52] U.S. Cl. ..... 30/191

[58] Field of Search ..... 30/173, 191, 192, 193, 30/190, 252, 349; 81/348

[56] References Cited

U.S. PATENT DOCUMENTS 2,806,394 9/1957 Briegel ..... 81/348

3,949,473 4/1976 Blanc ..... 30/191

*Primary Examiner*—Hien H. Phan

*Assistant Examiner*—Willmon Fridie, Jr.

*Attorney, Agent, or Firm*—Martin A. Farber

[57] ABSTRACT

A center-cutter with cutting jaws mounted swingably around bearing pins, the mounting being formed by means of straps connecting the cutting jaws in the back of the cutting-jaw region and of a tooth-space engagement connecting the two cutting jaws to each other. While retaining the known cross-over overlapping of a single piece formation of handles and pliers jaws, handles cross over without joint increasing the cutting output.

10 Claims, 5 Drawing Sheets

FIG. 6
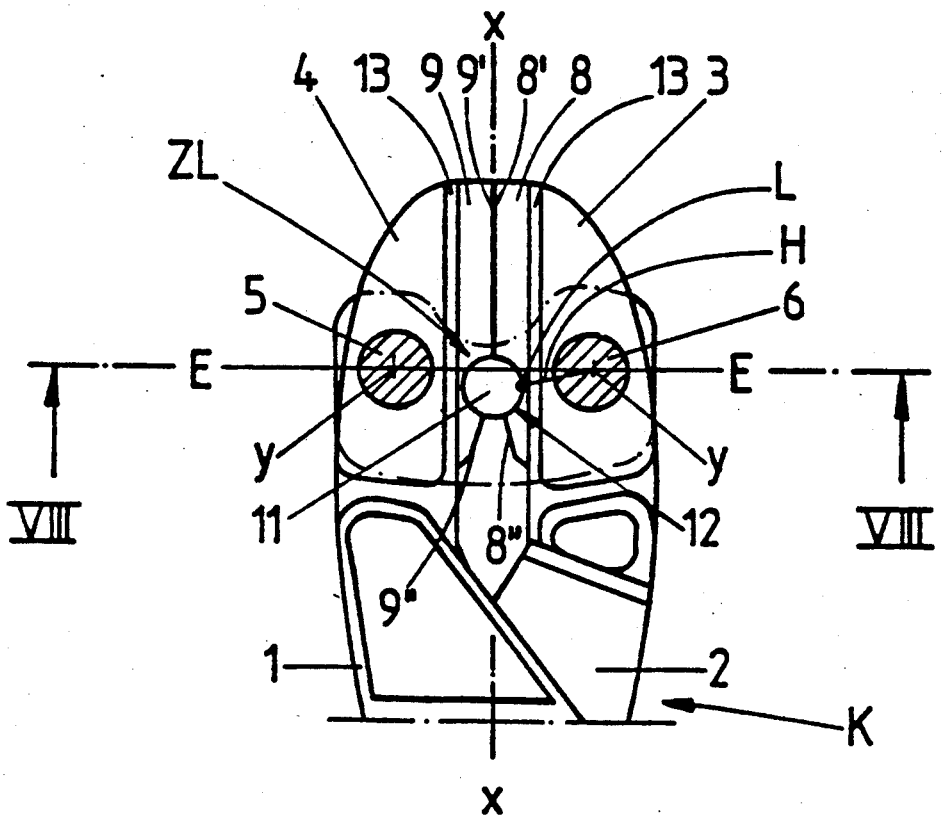
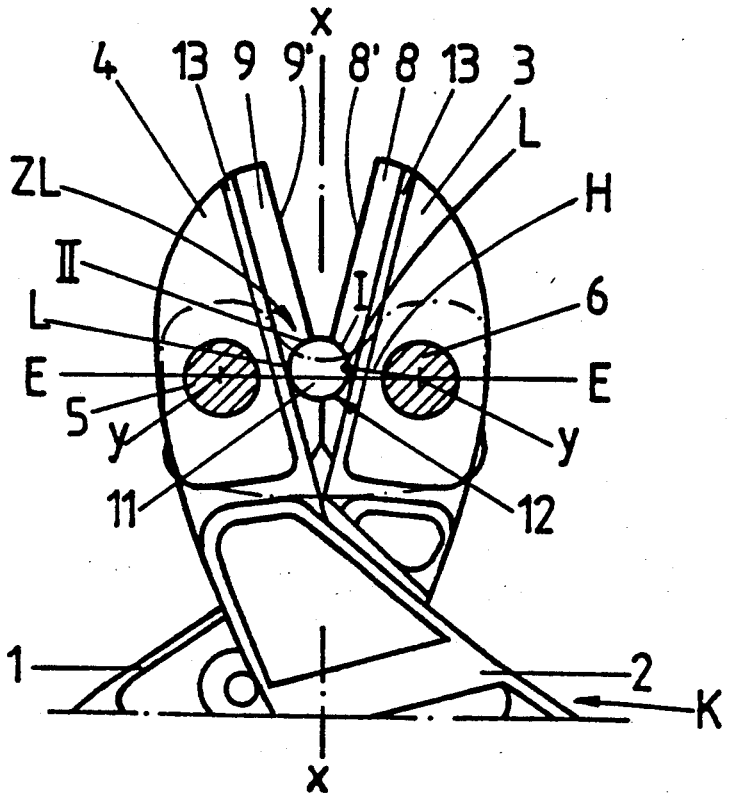
FIG. 7

FIG.10
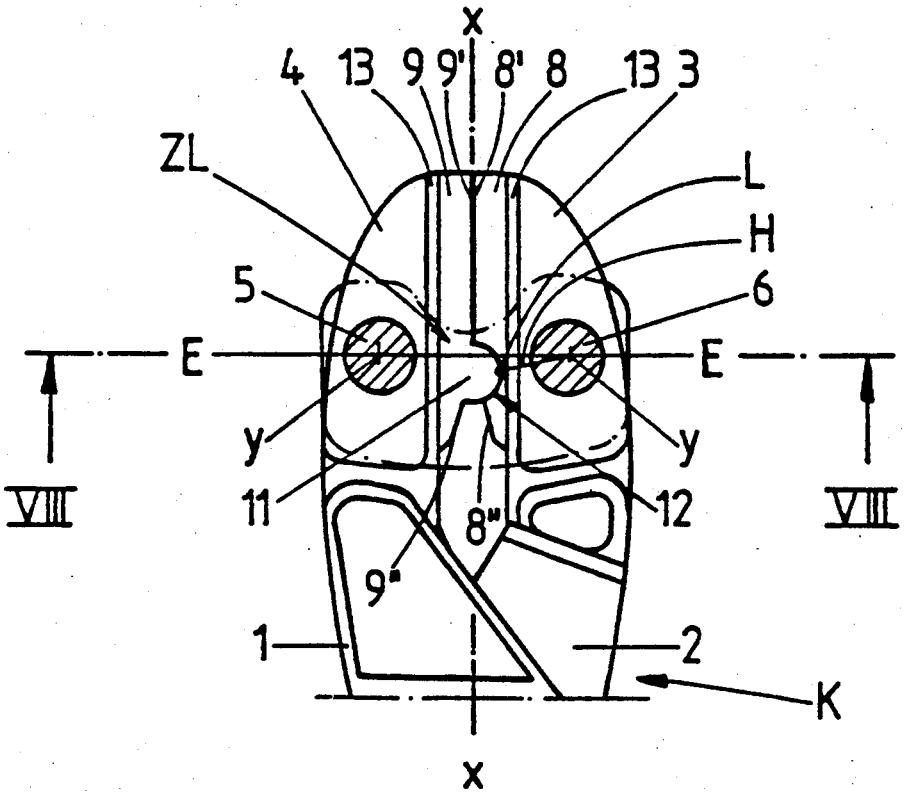
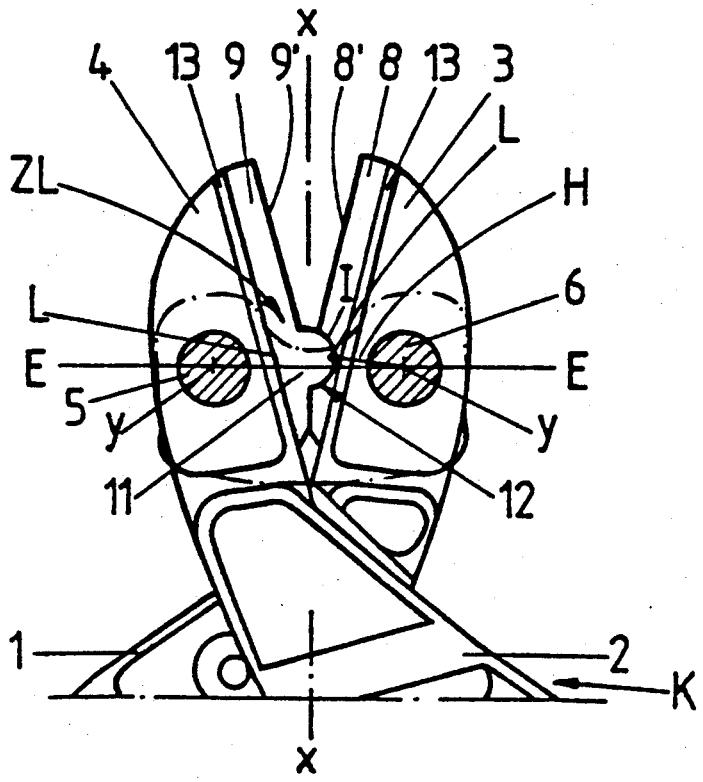
FIG.11

CENTER-CUTTERS

FIELD AND BACKGROUND OF THE INVENTION

The present invention relates to center-cutters in general, and to center-cutters with cutting jaws mounted swingably around bearing pins, in which the mounting is formed by means of straps connecting the cutting jaws behind teh cutting-jaw region and of a tooth-space engagement fastening the two cutting jaws to each other, in particular.

Side-cutters are known (for instance, Federal Republic of Germany OS 28 39 942), in connection with which the crossover overlapping of the plier arms, which is typical of pliers, is present in the region of the joint, i.e. the right arm of the pliers forms the left cutting jaw and the left arm of the pliers forms the right cutting jaw. The cutting jaws are mounted on a common joint pin. The cutting performance of such tools is adapted to the normal case.

Tools which apply a higher cutting force, so-called bolt-cutters with center-cutter, are available on the market. They operate with a lever transmission. For this purpose, the cutting jaws are each mounted on a separate pin. The handle-side jaw ends are pivotally connected to handles which are mounted one below the other via a joint pin. In this connection, the handles form double levers. The shorter lever acts on the end of the cutting jaws. Corresponding developments are relatively expensive. The cutting jaws are mounted or connected with respect to each other by straps and a tooth-space engagement. From Federal Republic of Germany OS 34 27 990 it is known, on such a bolt-cutter, to develop the shorter lever arm of the handle double lever, and therefore the handle heads, as cam-like crank parts which act in pairs and rest against each other. The handle heads are connected via a transverse strap. The latter engages on end bearing pins of the handle heads. This solution is found even more expensive.

SUMMARY OF THE INVENTION

It is an object of the invention to increase by simple means the cutting power of a tool of the introductory-mentioned type while retaining the classic cross-over overlapping and therefore the development of handle and pliers jaw in one piece.

According to the invention, the plier arms cross over without joint pin. While retaining the basic length of the tool, the force arm is longer; the means of articulation are now shifted into the head or cutting region. The cross-over region of the handles, which is free of a joint pin, can be used as a guide surface. Increased cutting power is accordingly optimized by a simple means in the manner that the cutting edges debouch into the outer surface of the toothspace engagement. The length of the load arm taken up by the joint surface between joint pin and the end of the cutting edge on that side is now a cutting edge.

In accordance with other features of the invention, one proceeds structurally further in the manner that a cylindrical roller body which forms the tooth-space engagement extends transverse to the cutting edge of wedge-shaped cross section and in each case is received in a corresponding penetration hollow formed by two hollow sections in the cutting edges in the manner that an approximately right-angle transition is obtained between the facets of the cutting edges and the walls of the hollow section. This leads to an extremely good cutting action; high cutting forces can be applied under very stable mounting conditions. The individual mounting of the cutting jaws in the strap via the cutting jaws results, in combination with the interposed rolling bodies, in an ideal fulcrum in the direct vicinity of the cutting edge. As a whole, there is, so to speak, a three-point attachment of the cutting-active region of the side-cutters. The penetration hollow which is formed to receive the rolling member proportionately in the cutting regions can not only be produced in a structurally simply manner (this zone is completely free for working) but, as a result of the enlargement of the supporting surface of the wall for the rolling member which increases in the depth of the hollow, creates a firm form-locked abutment for the rolling member. With increasing closing, which goes hand-in-hand with the occurrence of the cutting forces, this bottom, which favors a guiding of the rolling member, presses still more firmly against the outer surface of the rolling member; shearing forces which may cause a displacement of the jaws are rather taken up without damage. This is contributed to, not least of all by the fact that the facets pass at a right angle into walls of the hollow section. Relative or parallel displacements of the cutting jaws with respect to each other are in this way excluded. In this connection, as a further development of the invention, it proves advantageous that the lines of greatest length of the walls of the hollow section travel on the rolling member upon a closing of the center-cutters into a diametrically opposite position. Upon closing, an equal loading in optimally centered position of the cutting jaws is obtained, and therefore specifically in a phase in which the straps are under maximum tensile stress. It is furthermore of advantage that the rolling member snaps over a transverse plane defined by bearing pins of the pliers arms into a handle-side hyperextension position. With tight development of the tooth gap engagement, there is present a snapping action which secures the closing position and can be intentionally, or, in any event, noticeably, overcome in order to open the center-cutters. Furthermore, it proves favorable for the cutting action that the hollow sections are so arranged in the cutting edges that the rolling member protrudes partially beyond the cutting-edge-side strap edge when the center-cutters are open. In this way, the innermost narrowing point (vertex) of the angular cutting jaw lies free. The object to be cut can be placed deep and, in particular, as close as possible in the region of the ideal joint pin. With the closing of the cutting jaw, the rolling member is even pulled further inwardly, i.e. out of this protruding position to beneath the straps which are arranged in pairs. This results, in practice, even in a pulling in of the wire section to be cut. Since the cross section of the rolling member moves away under the straps, there is a bending movement, so that the cutting notch in the case of harder material even leads in superimposed manner to a break behavior. It is furthermore advantageous that the hollow sections are of lenticular shape as a result of the penetration. Furthermore, it is proposed that the rolling member be fastened in one of the hollow sections. The number of structural parts is accordingly reduced. The fastening can be effected by brazing. One development which is particularly favorable for manufacture is that the rolling member of one or the other cutting edge be developed as an identically forged projection. This reduces, in particular, the number of parts and the play. Furthermore, it is advantageous with respect to the force-favorable handling that the handles form, at a hand-width distance from the free end of the handle, a fillet which lies at a corresponding distance from the cross-over region of the plier arms, the handle sections which extend from this fillet extending curved outwardly in arched manner and the free end sections adjoining a second fillet assuming a slightly diverging course. In this way, good ergonometric conditions are present. Finally, the invention also proposes that the cutting edges pass, adjoining a jaw taper step, into the full thickness of the cutting jaws. In this way, the portions of the cutting jaws that are lying flat on the straps are considerably broader. The guidance is accordingly a large-area guidance and therefore better. The cutting edges are seated practically in the manner of a ledge on the sides of the cutting jaws facing each other.

BRIEF DESCRIPTION OF THE DRAWING

With the above and other objects and advantages in view, the present invention will become more clearly understood in connection with the detailed description of preferred embodiments, when considered with the accompanying drawings, of which:

FIG. 6 is an enlarged view of the head of the center-cutters in closed position;

FIG. 7 is a similar view in an open position;

FIG. 10 is a view, similar to FIG. 6, of a modified embodiment; and

FIG. 11 shows the plier of FIG. 6 in open position.

DETAILED DESCRIPTION OF THE PREFERRED EMBODIMENTS

The center-cutters shown has two handles 1,2 which are continued, crossing over the region of the joint, in, in each case, into cutting jaw 3,4.

Each handle 1,2 is turnably mounted on a special bearing pin 5 or 6, respectively, said pins extending on both sides of the axis of symmetry x—x of the side-cutters. They lie on a common transverse plane E—E to same as well as transverse to the plane of swing of the cutting jaws.

Figure 1:
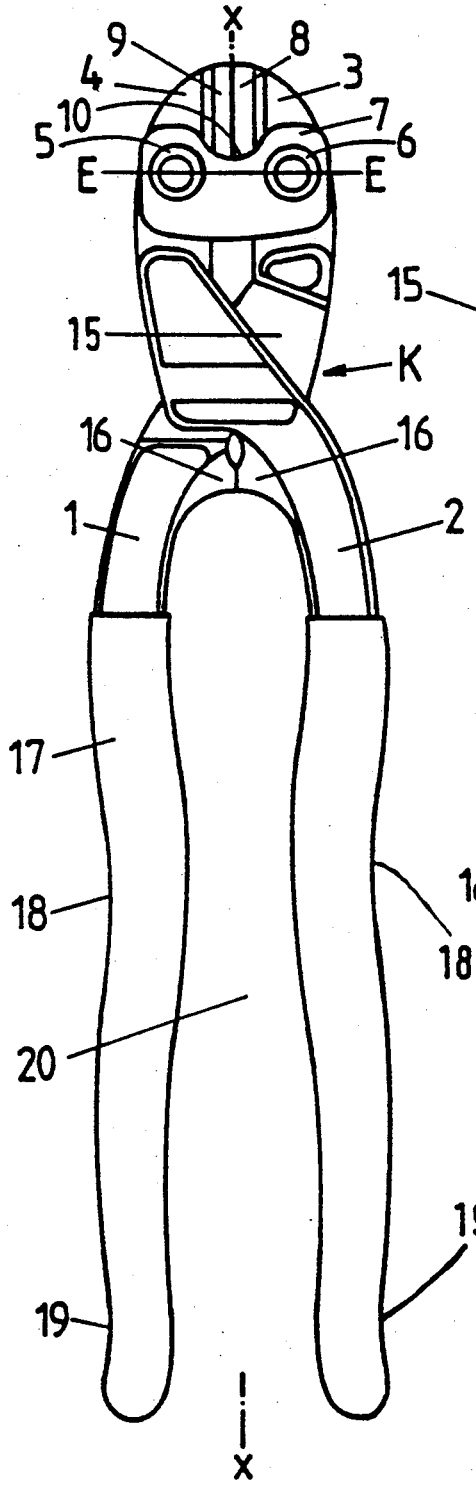
FIG. 1 shows the center-cutters developed in accordance with the invention; seen in side view.
Figure 2:
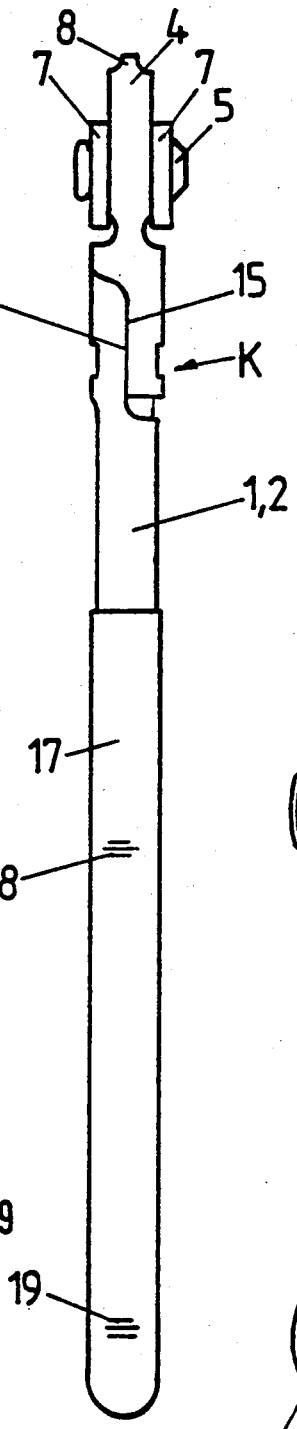
FIG. 2 is a view of FIG. 1 seen from the left-hand narrow side.
Figure 3:
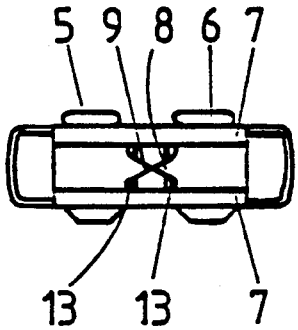
FIG. 3 is a top view of FIG. 1.
Figure 4:
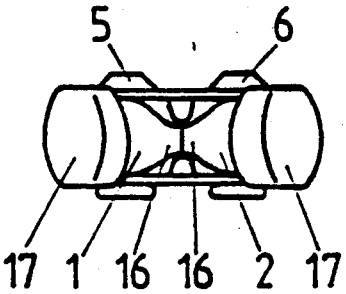
FIG. 4 is a corresponding bottom view.
Figure 5:
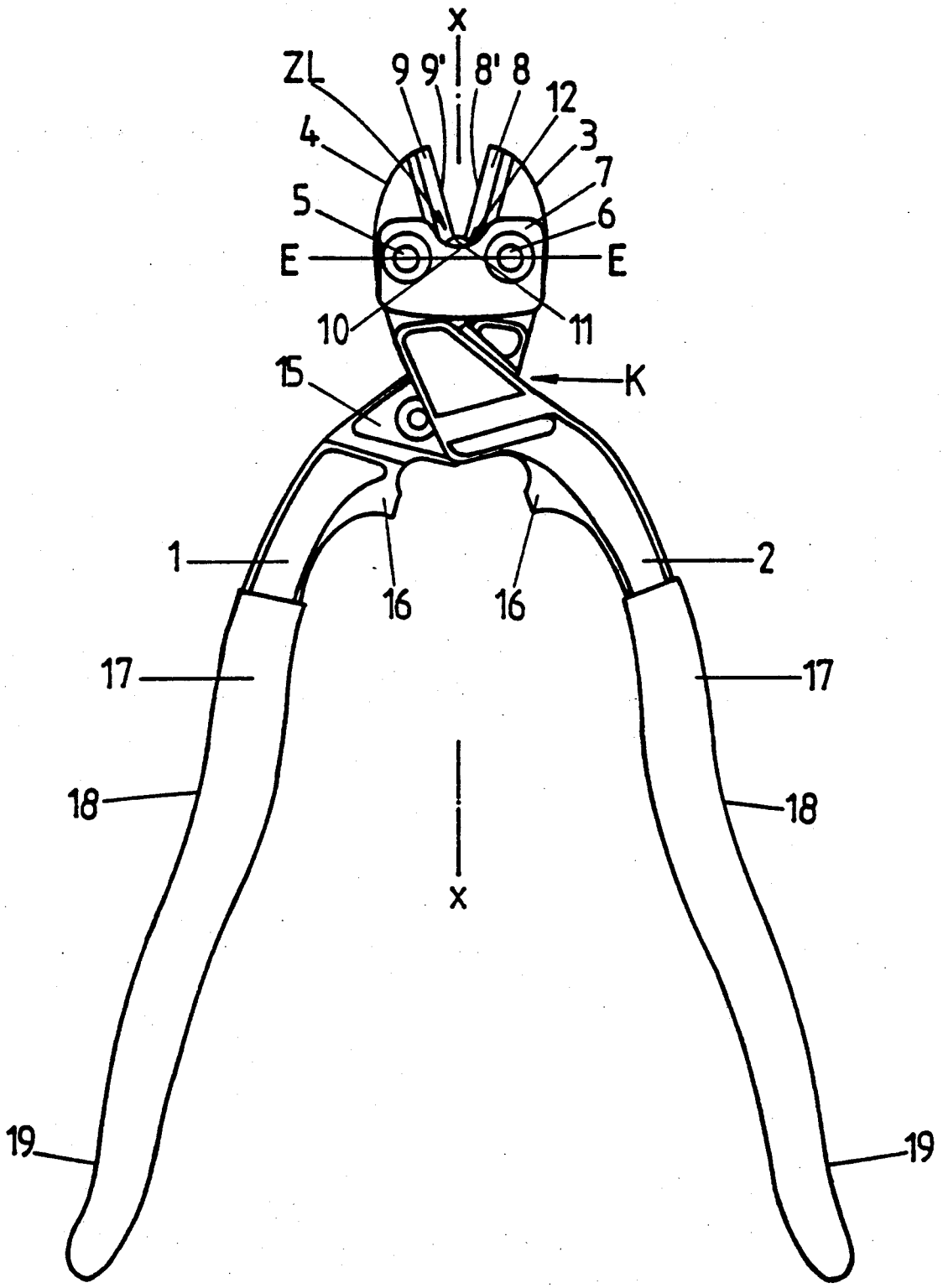
FIG. 5 shows the center-cutters with cutting jaws open.

The bearing pins 5,6 pass through cross sectionally adapted passage openings of two straps 7. These flat straps, which are arranged in pairs and extend in the plane of swing of the cutting jaws 3,4 and handles 1,2, hold, guided between them, the transition region between the cutting jaws 3,4 and handles 1,2. The straps 7, which are cut basically in a long rectangle, have their longer side extending in the direction of the transverse plane E—E (see FIG. 1).

For the fastening of the bearing pins 5,6, the latter have heads on one side and are riveted on the other side. The heads are of frustoconical shape and the rivetings are transversely rounded.

In the region of cutting edges 8,9 of the cutting jaws 3,4, which are directed toward each other, the straps 7 have a rounded niche 10. The latter has a centering action for the object to be cut, for instance wire.

Figure 8:
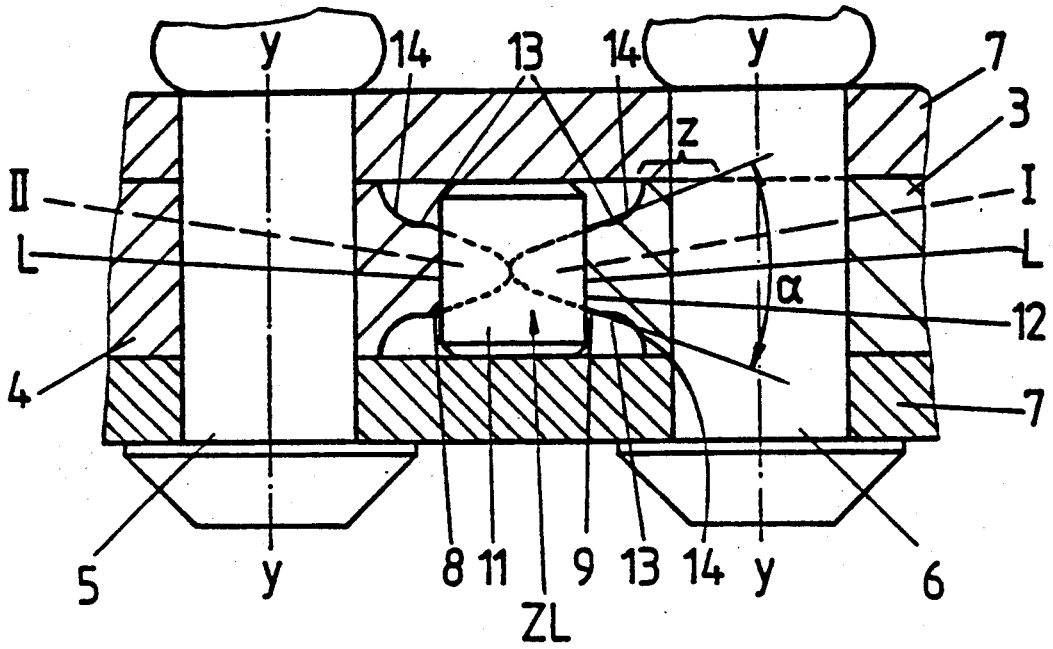
FIG. 8 is a section along the line VIII—VIII of FIG. 6, further enlarged.
Figure 9:
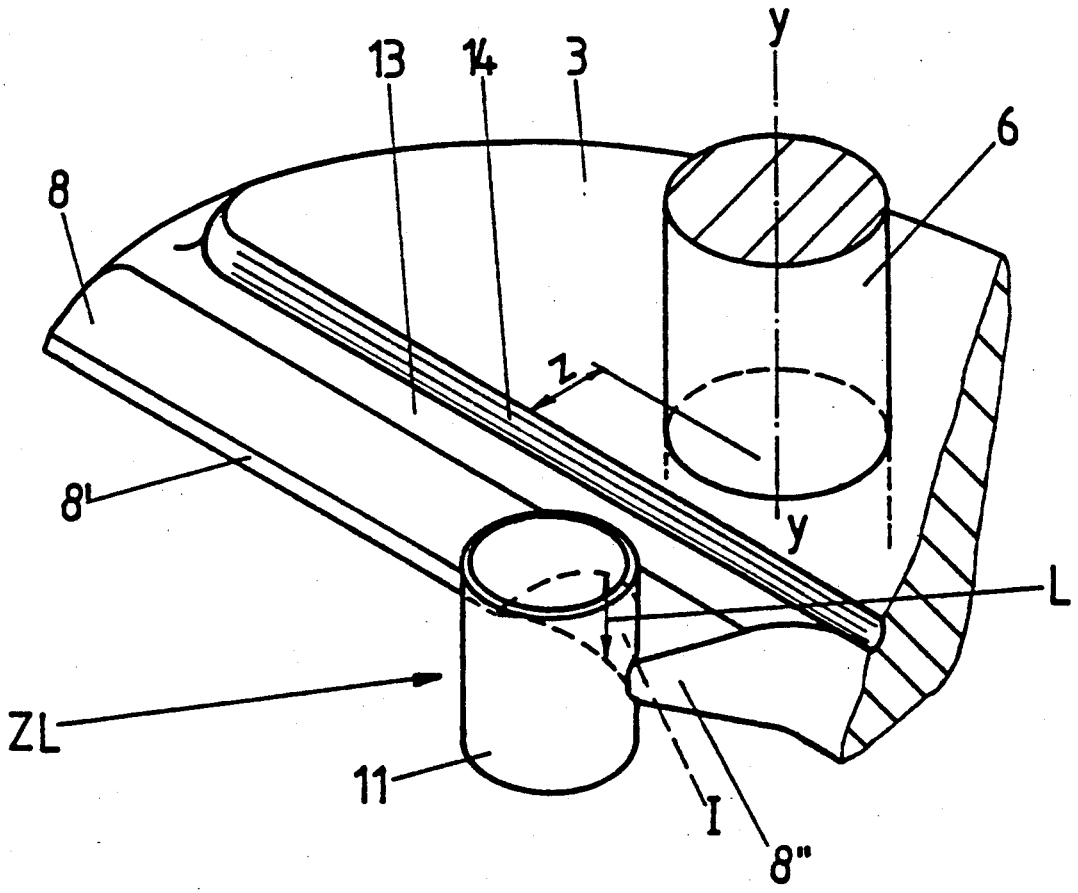
FIG. 9 is a perspective view of the rolling member arrangement on one of the cutting jaws.

At the same distance from the bearing pins 5,6 there is arranged between them a rolling member 11. The latter forms a sort of tooth-space engagement ZL between the cutting jaws 3,4 and is of cylindrical shape. Its edges are beveled (FIG. 8). Its axial length corresponds to the inside distance between the straps 7 which are arranged parallel to each other or, stated more precisely, the thickness, measured in this direction, of the cutting jaws 3,4. The cylindrical rolling member 11 which thus extends transversely to the cutting edges 8,9 is seated in each case proportionally in a corespondingly formed penetration hollow 12 of two hollow sections I,II of the cutting edges 8,9. Since the cutting edges 8,9 are of wedge shape and the rolling member 11 is of cylindrical shape, the hollow sections I,II have a lenticular wall contour (see FIG. 9). The facet 8' or 9' of the respective cutting edge 8 or 9 which extends on the cutting-edge side to the outer wall of the cylindrical roller member 11 comes to a point at the region of transition to the hollow sections I,II. Starting from there, the wall of the hollow section I,II is increasingly enlarged so that its line L of transverse extent has its greatest length approximately at the transverse plane E—E. From there the area of the wall decreases again correspondingly.

In the closed position of the pliers, this line L of transverse extent both hollow sections I,II forming the receiver for the rolling member lies at least in the direct connecting line between the center lines y-y of the two bearing pins of 5,6. In a preferred embodiment (cf. FIG. 6), the rolling member 11 even assumes a position which extends beyond this line in the direction of the handles 1,2.

Accordingly, in the final phase of the cutting movement there is an increasingly firm insertion of the rolling member 11 in the penetration hollow 12. From this follows a precise pivotal support of the cutting edge. All parallel displacement of the cutting jaws 3,4 is prevented.

Since the line L of both hollow sections I,II passes into a position of hyper-extension, even though only slightly so (FIG. 6), the corresponding passage over the dead center can be utilized in practice also for a dependable securing of the center-cutters in the stop-limited closed position. The lever leading to this line, which extends from the longitudinal axis y—y, is designated H. It forms an acute angle of only a few degrees with the transverse plane E—E, for which reason the passage beyond the dead center position upon sufficiently tight insertion of the rolling member 11 can be noted as merely a slight clamping position which, however, is entirely sufficient for the purpose indicated. In each case a toggle-lever-like passage takes place.

The hollow sections I,II in the cutting edges 8,9 are furthermore so arranged that the rolling member 11, with the side- cutters open, protrudes in part beyond the cutting-edge-side strap edge with respect to the base of niche 10. To this extent, the opening jaw travels in the direction toward the object to be cut. This, and the fact that the entire length of the facet 8' or 9' up to the outer wall of the rolling member 11 is available for the cutting section, results in an extremely good cutting performance and convenient handling. With the closing of the handles 1,2 of the center-cutters, the rolling member, which rests via its end surfaces on the inner surfaces of the straps 7, travels back again into its position of complete axial area support. The beveled edges avoid any wear. In the open position, about half the cross-sectional area of the rolling member is free.

The cutting edges 8,9 connect via a definite step 13 into the maximum jaw thickness. This jaw taper step 13 is located on both sides of the cutting jaws 8,9. The reduction is about 50%. The transition into the thicker section of the cutting jaws 3,4 is concavely rounded and bears the reference numeral 14. The cutting edges 8,9, which taper outwardly after the jaw reduction step 13, pass into the blunter facet 8' and 9', respectively. The cutting line coincides with the longitudinal center line x—x of the center-cutters on which the rolling member moves. The cutting angle Alpha X of the cutting edges 8,9 is 40°. The interruption in the course of the cutting flank as a result of the step 13 results in an increase in area of the width z for the strap-side guidance of the cutting jaws 3,4. In this connection, z corresponds to somewhat more than the radius of the rolling member.

The crimped cross-over region of the handles 1,2 which adjoins behind the straps 7 on the handle side, is clearly widened as compared with the handle and jaw zone, in the interest of the large-area guide surfaces 15.

In accordance with a variant shown in FIGS. 10 and 11, the tooth-space engagement ZL is so developed that the rolling member 11 is fastened in one of the hollow sections I,II. The fastening can be effected by brazing. There is preferred, however, a development such that the rolling member 11 is associated with one or the other cutting edges 8,9, in this case the cutting edge 9, as a directly forged-on projection. The projection has the shape of half a rolling member, divided as seen in axial view. The supportactive outer surface takes into consideration the need of movement for the opening of the jaw and is therefore somewhat larger than said half.

Otherwise the same construction is present as described. The reference numbers have therefore been employed in corresponding manner, without repetition of the text.

The outer wall of the developed rolling member 11 is continued in FIGS. 10 and 11, to be sure, also as a penetration line, but for a clearer understanding of the nature of the single part, the fastening-jaw-side arc line has, however, been omitted.

Directly behind the cross-over region, the handles 1,2 form stop spurs 16 which are directed against one another and which define the closed position of the cutting edges 8,9.

The limitation of the opening is formed by handle-side diverging sections 8" and 9" of the cutting jaw parts which lie on the other side of the penetration hollow 12.

The length ratio of cutting jaw 3 and 4 to handle 1 and 2 is about 1:10. Half the length of the cutting edge 8,9 devolves on the lever H.

An insulation 17 is applied, preferably shrunk, onto the slightly undulated handles 1,2.

The undulation of the handles is of such a nature that the handles 1,2 form on the outside a fillet 18 the distance of the width of the hand from the free end of the handles. The fillet 18 of both handles 1,2 lies on a common transverse plane. The distance between fillet 18 and the free ends of the handle is approximately the same as the distance between the lowest point of the fillet 18 and the cross-over region K. These spacing zones are curved outwardly and therefore impart the entire handle two more bulged zones. The insulation 17 terminates approximately in the center of the plier-head-side handle section. As can be noted from the drawing, the free end sections adjoining a second outside fillet 19 present there have assumed a slightly diverging course. All sections pass arched into one another.

The first fillet 18 and the total curved section adjoining the handle-end side permits an optimal grasping hold adapted to the ergonometric conditions of the operating hand, with the resting of the root of the thumb in one or the other first fillets 18. The four fingers of the operating hand grip over the arched section of the other handle. Since the handle sections have an arching which corresponds to the arching of the palm of the hand, high actuating forces can be applied.

The double-barrel shape of the handle as seen in silhouette even makes possible operation with two hands since the handle sections are of the same length on both sides of the first fillet 18 and therefore the two of them have a spacing equal to the palm of the hand.

On the other hand, the handles 1,2 are so spaced from each other that fingers extending, for instance, into their intermediate space 20 cannot be pinched.

We claim:

1. A center-cutters comprising two arm shaving at one of their ends two cutting jaws respectively mounted swingably around respective bearing pins of a mounting, said mounting being formed of straps behind a cutting-jaw region connecting the cutting jaws by said bearing pins and of a tooth-space engagement means fastening the two cutting jaws to each other, said arms cross over freely without joint pin, and said cutting jaws have cutting edges, said cutting edges of said cutting jaws extend up to an outer surface of the tooth-space engagement means, the latter comprising a cylindrical member extending transversely to the cutting edges.

2. The center-cutters according to claim 1, wherein said cutting jaws have cross sectionally wedge-shaped cutting edges having facets, said member is a cylindrical rolling member and extends transversely to the cutting edges and respectively proportionally in two hollow sections in the respective cutting edges forming a corresponding penetration hollow such that an approximately right-angle transition is provided between the facets of the cutting edges which terminate directly on the rolling member and walls of the hollow sections.

3. The center-cutters according to claim 2, wherein respective lines of greatest transverse extend of the respective walls of the hollow sections shift relative to the rolling member upon closing of the center-cutters into a position substantially diametrically opposite each other.

4. The center-cutters according to claim 3, wherein said bearing pins between their center lines define a transverse plane, said arms have a handle side, and said rolling member snaps over said transverse plane into a position of hyper-extension which is on said handle side of said arms upon closing of the center-cutters.

5. The center-cutters according to claim 2, wherein said hollow sections are arranged in the cutting edges such that when the cutting jaws are open said rolling member projects partially beyond an edge of the straps adjacent to said cutting edges and when the cutting jaws are closed said rolling member retracts behind said edge of the straps, respectively.

6. The center-cutters according to claim 2, wherein said hollow sections are approximately lenticular in shape with said cylindrical rolling member penetrating therein.

7. The center-cutters according to claim 2, wherein said rolling member is fastened to one of the hollow sections of one of the cutting edges.

8. The center-cutters according to claim 7, wherein said rolling member in said one of the hollow sections of one of the cutting edges is formed as a projection which is directly forged thereon.

9. The center-cutters according to claim 1, wherein said arms at their other ends form handles, said handles form, at a distance equal to a width of a palm of a hand a free end of the handle, a first fillet located at a corresponding distance to a cross-over region of the arms, said handles having handle sections extending from the first fillet outwardly on a curve and free end sections of the handles adjoining a second fillet assuming a slightly diverging course.

10. The center-cutters according to claim 1, wherein each of said cutting edges adjoins a jaw-taper step and continues into a full thickness of the respective cutting jaws.

* * * * *